US006101906A

United States Patent [19]

Tai

[11] Patent Number: 6,101,906

[45] Date of Patent: Aug. 15, 2000

[54] ADJUSTABLE SPANNER HAVING RELEASABLE ENGAGEMENT SECURING MECHANISM

[76] Inventor: Daniel Tai, 4519 Hatch La., Lisle, Ill. 60532-4360

[21] Appl. No.: 09/282,201

[22] Filed: Mar. 31, 1999

[51] Int. Cl.[7] ..... B25B 13/12

[52] U.S. Cl. ..... 81/129; 81/167; 81/170

[58] Field of Search ..... 81/129, 129.5, 81/155, 165–167, 150–151, 170

*Primary Examiner*—D. S. Meislin

*Attorney, Agent, or Firm*—Rosenberg, Klein & Lee

[57] ABSTRACT

An adjustable spanner having a releasable engagement securing mechanism is provided. The spanner comprises a spanner handle, a first holding portion, a second holding portion, a third holding portion, an adjustment member, a push rod, and at least one resilient element. Each of the first, second, and third holding portions defines respective contact surfaces. The first holding portion is fixedly coupled to one end of the spanner handle, while the second holding portion is displaceably coupled to the spanner handle. The third holding portion is displaceably coupled at the given end of the spanner handle. An adjustable U-shaped region is collectively formed by the three contact surfaces. A push rod disposed in displaceable manner within the spanner handle is coupled to the third holding portion for actuating the displacement thereof between a clamping position and a releasing position. The push rod is provided with an actuation button by which it may be displaced relative to the spanner handle.

9 Claims, 8 Drawing Sheets

ADJUSTABLE SPANNER HAVING RELEASABLE ENGAGEMENT SECURING MECHANISM

FIELD OF THE INVENTION

The present invention relates to a spanner, and more specifically to a spanner having three contact surfaces for clamping a nut tightly, and a mechanism by which a user can conveniently and rapidly re-orient the spanner.

BACKGROUND OF THE INVENTION

A spanner is a generally used tool for rotating a nut or other part. An adjustable spanner (i.e. a movable spanner) has been used in the prior art. These spanners are disclosed for example in Taiwan Patent Publication Nos. 251500, 257126, 274755, 302793, 304909, 308925, 310647, 312187, 312188, and 340437.

However, prior art adjustable spanners only have two surfaces for engaging contact with a nut so that often the nut cannot be clamped tightly. This requires a larger force than necessary to clamp the nut. Consequently, the edges of the nut may be destroyed, effectively rendering the nut useless, as it cannot then be locked tightly or released.

Moreover, nuts are sometimes located in a cramped space (as shown in FIG. 1). Yet, a prior art spanner 10*a*, during operation, is engaged to the nut 11*a* in a first position A, then rotated to a second position B. The whole spanner 10*a* is thereafter pulled out of engagement with the nut 11*a* and returned to the first position A for repetition of the process. Therefore, the operation is time consuming.

SUMMARY OF THE INVENTION

Accordingly, it is a primary object of the present invention to provide an adjustable spanner having a quickly releasable engagement securing mechanism. The spanner has three contact surfaces defining a U-shaped region for tightly clamping a nut.

Another object of the present invention is to provide an adjustable spanner that may be quickly re-positioned. The uppermost of three contact surfaces defined by the spanner may perform a releasable clamping action upon the U-shaped region.

During use, the spanner is positioned at a first position and then rotated to a second position. A push rod may then be actuated to release a given nut from clamped engagement within the U-shaped region. The user can thereafter rotate the spanner back to the first position without entirely removing the spanner from its engagement position. If a button on the push rod is released, the contact surfaces of the U-shaped region will again clamp the nut so that rotation toward the second position may be effected.

The various objects and advantages of the present invention will be more readily understood from the following detailed Description when read ion conjunction with the appended Drawings.

DETAILED DESCRIPTION OF THE PREFERRED EMBODIMENTS

Figure 1:
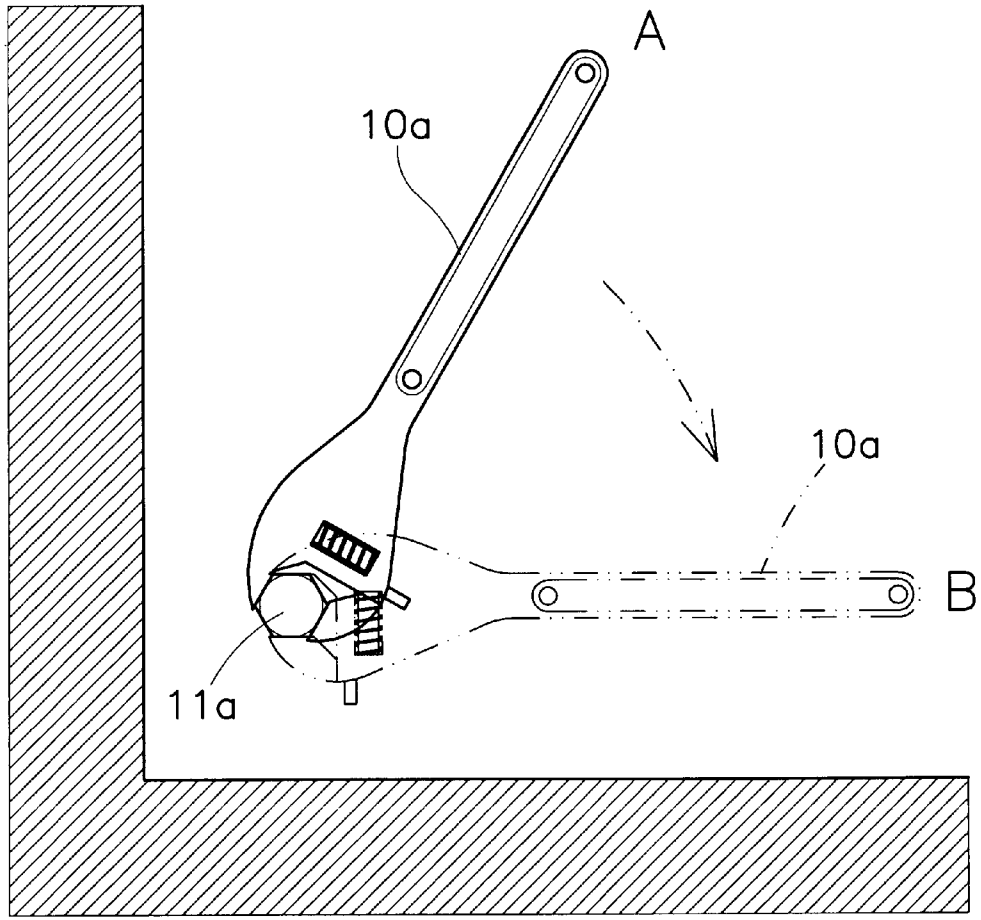
FIG. 1 PRIOR ART
FIG. 1 is a schematic view showing an application of a prior art spanner.
Figure 2:
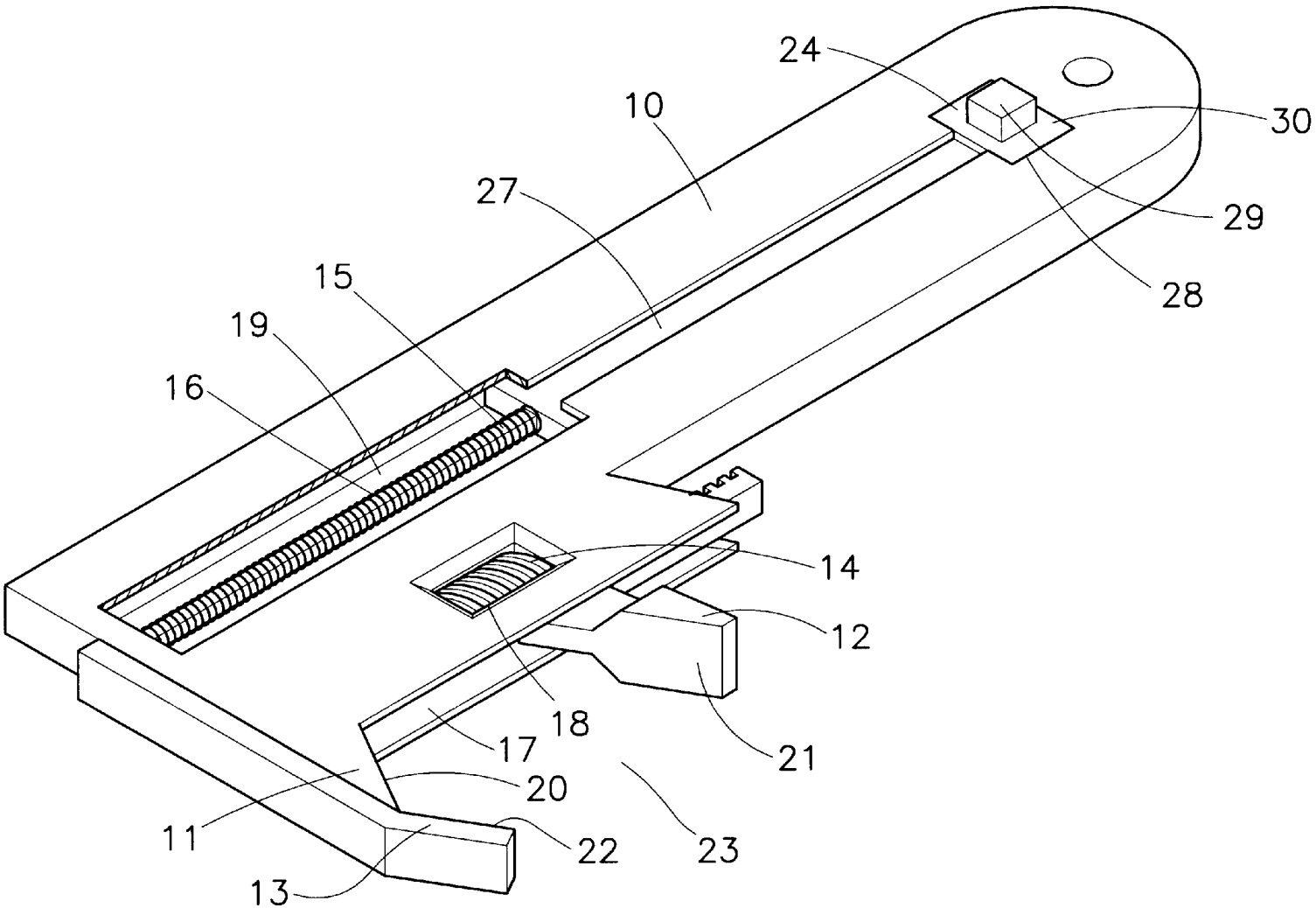
FIG. 2 is a perspective view showing the inner structure of a first embodiment of the present invention.
Figure 3:
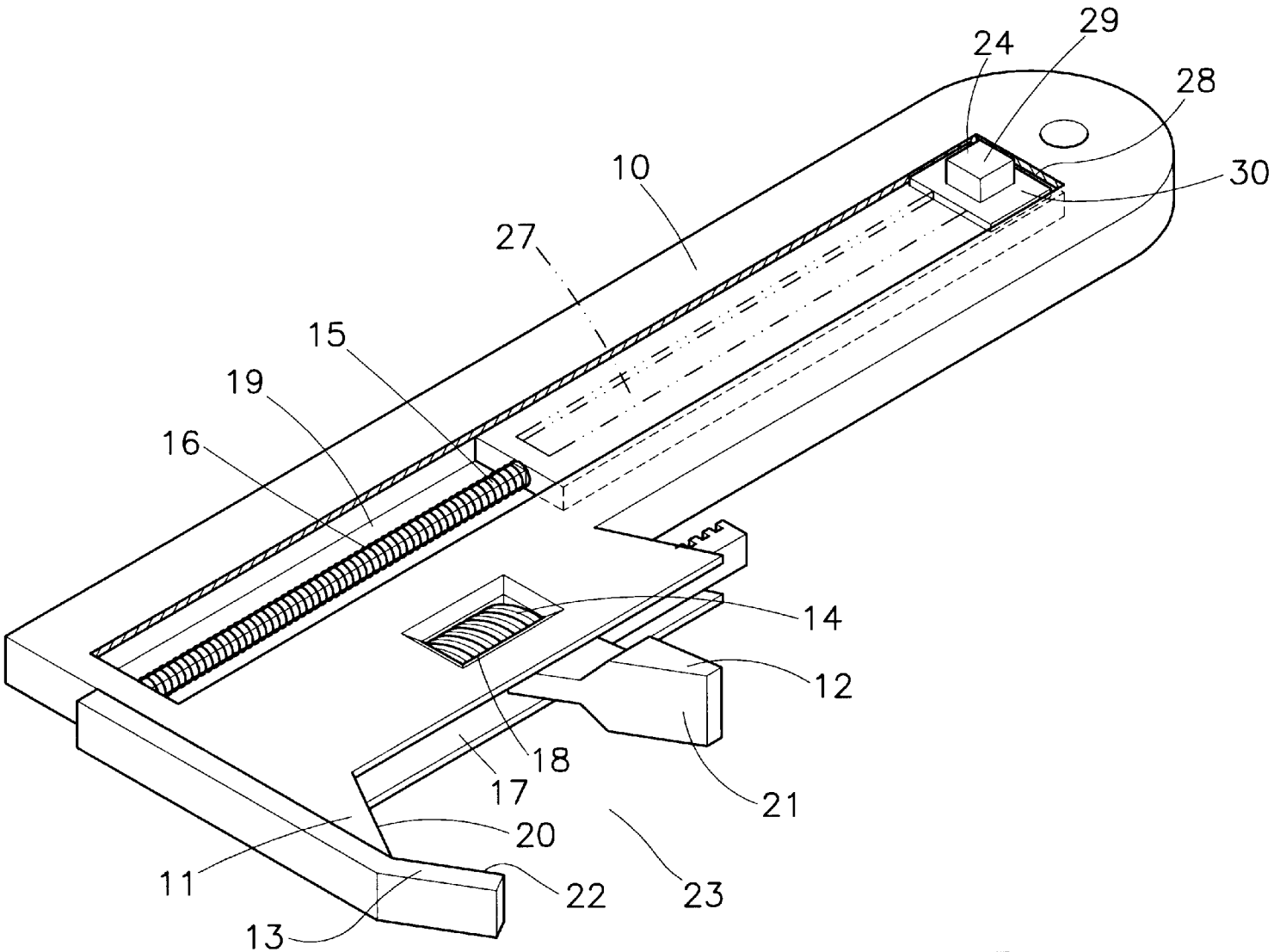
FIG. 3 is a perspective view, partially cut away, showing the inner structure of the first embodiment of the present invention.
Figure 4:
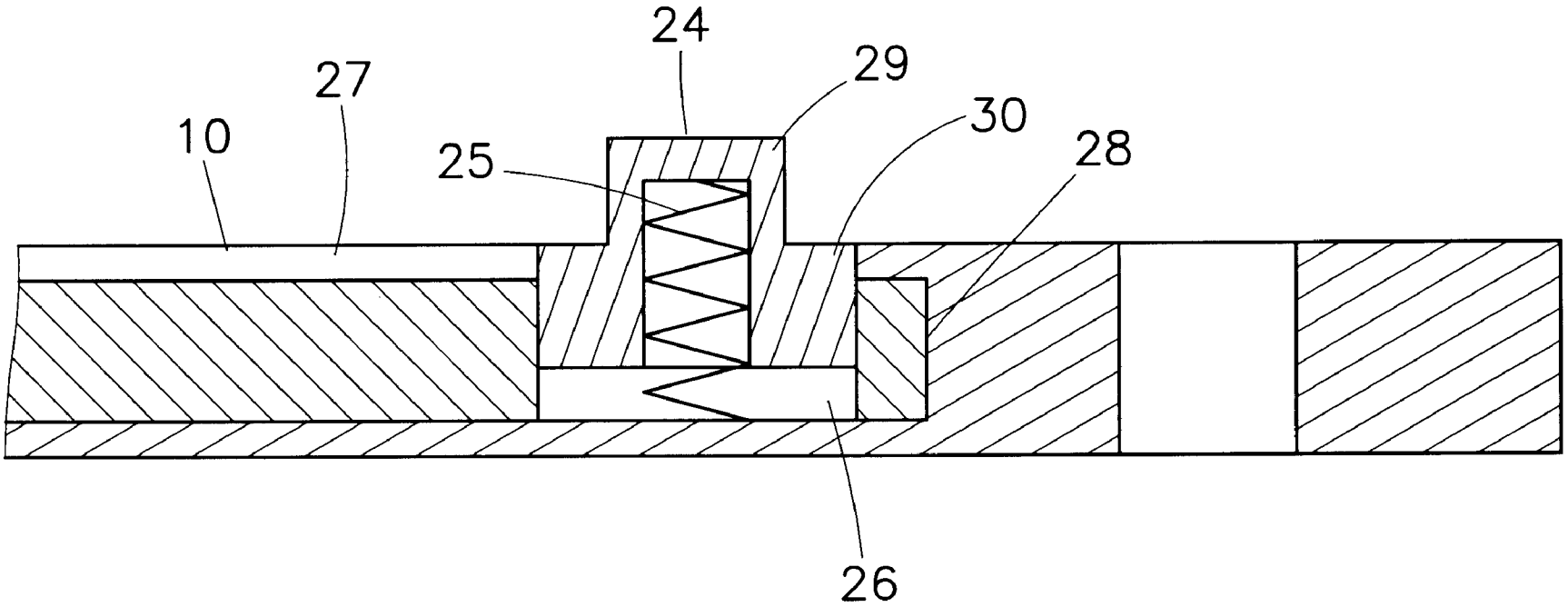
FIG. 4 is a sectional view showing a push rod and button according to the first embodiment of the present invention.

With reference to FIGS. 2, 3, and 4, an adjustable spanner according to the present invention is disclosed. The spanner comprises a spanner handle 10, a first holding portion 11, a second holding portion 12, a third holding portion 13, an adjustment member 14, a push rod 15, and a resilient element 16. The spanner handle 10 is configured as a longitudinally extended rod having a predetermined length. One side of the spanner handle 10 is formed with a guide groove 17. A first assembling hole 18 and a long second assembling hole 19 are formed in the spanner handle 10.

The first holding portion 11 is secured to one end of the spanner handle 10. The first holding portion 11 defines a first contact surface 20. The second holding portion 12 displaceably engages the guide groove 17 on one side of the spanner handle 10 so as to freely move within that guide groove 17. The second holding portion 12 defines a second contact surface 21. The third holding portion 13 is displaceably installed at one end of the spanner handle 10. The third holding portion 13 defines a third contact surface 22. A substantially U-shaped section is formed by the first contact surface 20, the second contact surface 21, and the third contact surface 22. The adjustment member 14 is configured as a stud which is pivotally disposed in the first assembling hole 18 of the spanner handle 10 and may rotate freely. One side of the second holding portion 12 is engaged with the adjustment member 14, such that the rotation of the adjustment member 14 will advance the second holding portion 12 to move longitudinally upwards and downwards for adjusting the position of the second contact surface 21.

The push rod 15 is integrally formed and firmly secured to one end of the third holding portion 13. The push rod 15 is displaceably installed in the second assembling hole 19 of the spanner handle 10. By longitudinally upward pushing of the push rod 15, the U-shaped region 23 may be expanded to a releasing configuration. The resilient element 16 is disposed about a portion of the push rod 15 to move longitudinally downwards (away from the first contact surface 20) such that the uppermost third contact surface 22 can perform a clamping action at the U-shaped region 23.

A button 24 can be installed at the push rod 15 for pushing the push rod 15 longitudinally upwards. The button 24 is positioned in a positioning hole 26 near a lower longitudinal end of the push rod 15 by a resilient element 25. The lower longitudinal half section of the second assembling hole 19 of the spanner handle 10 is formed with a slot 27 having substantially a T-shaped sectional contour. The lower longitudinal end of the T-shaped slot 27 is connected to a positioning groove 28. The button 24 is normally positioned within the positioning groove 28. The button 24 has a first portion 29 of less width than that of a second portion 30. The button 24 is biased outward by the resilient element 25 such that the second portion 30 of a larger width is aligned with the narrow portion of the T-shaped slot 27 when the button 24 is positioned at the positioning groove 28. Then the button 24 cannot move longitudinally upwards. When the button 24 is pushed in, the wider second portion 30 of the button 24 is depressed to align with the wider inner portion of the T-shaped slot 27 while the narrow first portion 29 of the button 24 is aligned with the narrow portion of the T-shaped slot 27. Now, the button 24 may be displaced longitudinally upwards within the T-shaped slot 27.

Figure 5:
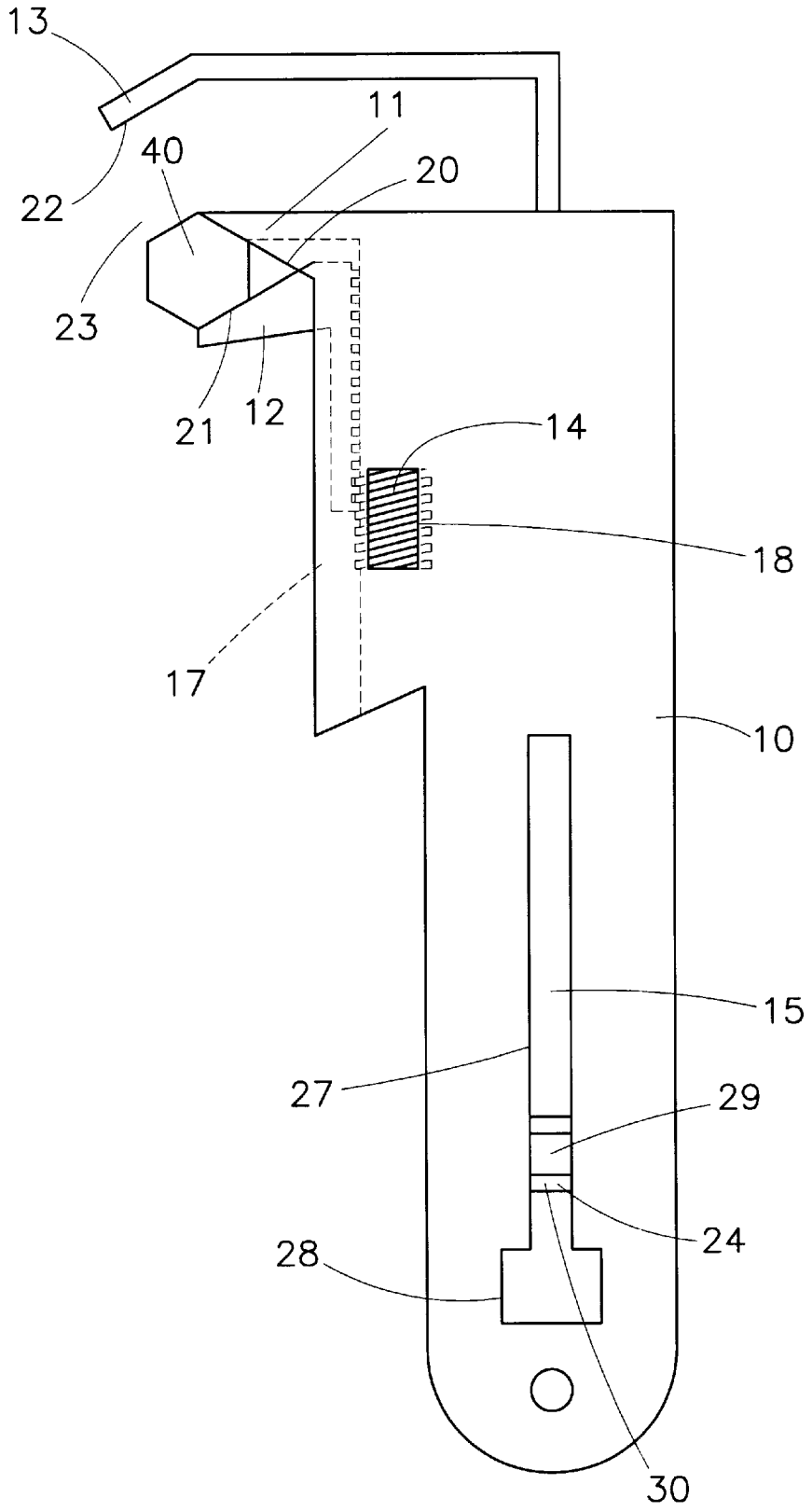
FIG. 5 is a schematic view of the first embodiment of the present invention shown performing a releasing action.
Figure 6:
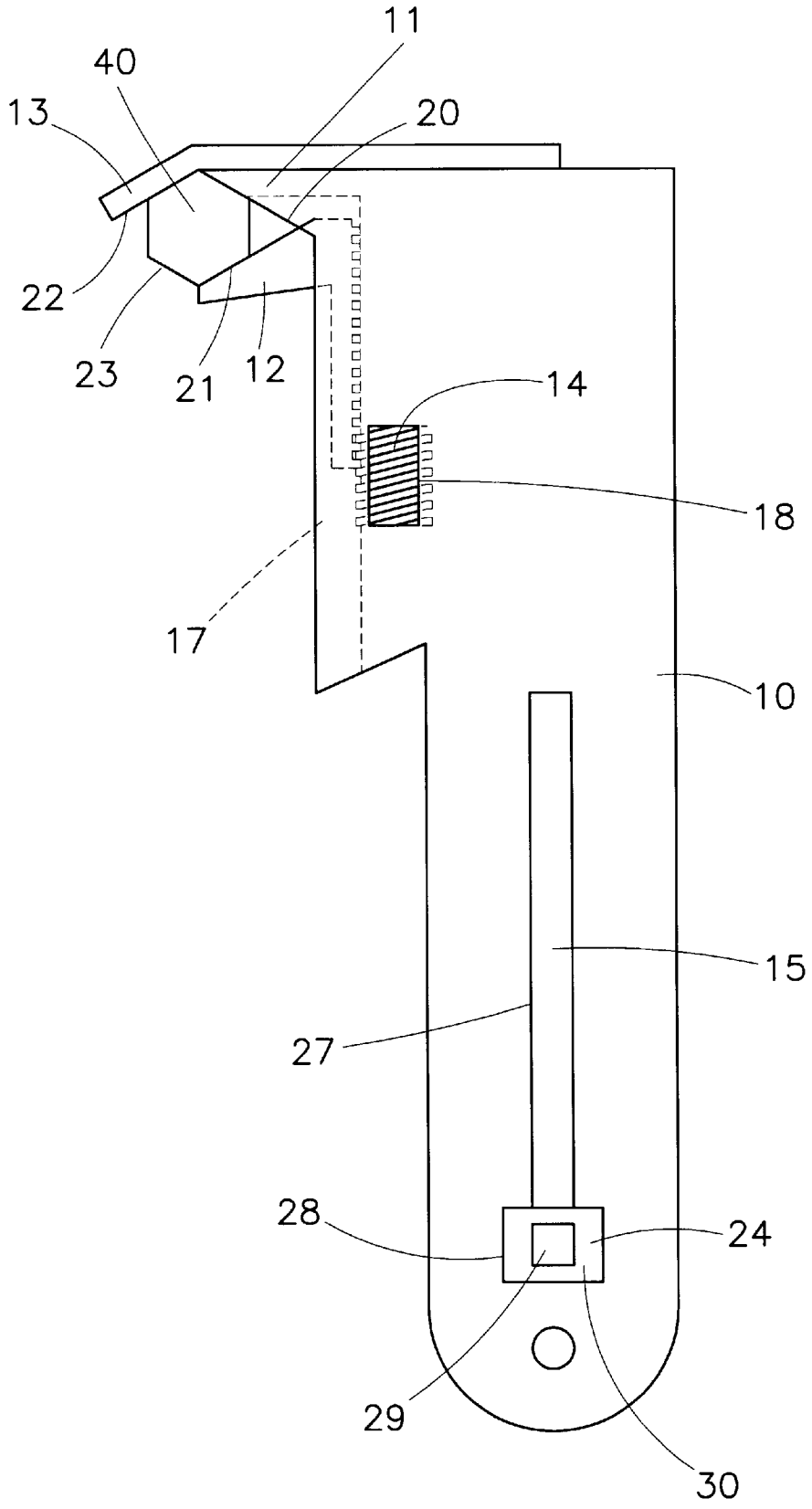
FIG. 6 is a schematic view of the first embodiment of the present invention shown performing a clamping action.

As shown in FIGS. 5 and 6, the spanner according to the present invention includes three contact surfaces 20, 21, and 22 for engaging a nut 40. Thus, the nut 40 can be securely engaged, being clamped by the U-shaped section (as shown in FIG. 6). After the adjustment member 14 is rotated to drive the second holding portion 12 against the nut 40, the first holding portion 11 and the second holding portion 12 are kept fixed, while the uppermost contact surface 22 of the three contact surfaces 20, 21, and 22 may resiliently clamp or release the nut 40 (by virtue of the push rod 15 and the resilient element 16). Thus, after it is positioned at a first position, the spanner may be rotated to a second position. Therefore, if release of the U-shaped region 23 is desired, it is only necessary to displace the push rod 15 longitudinally upwards, via the button 24. The third holding portion 13 will then be drawn away from the spanner handle 10 (as shown in FIG. 5) and the nut 40 released from engagement to permit re-orientation of the spanner back to the first position. The user may thus rotate the spanner back to the first position without having to re-adjust the adjustment member 14. If the button 24 on the push rod 15 is released by the user, the bias of the resilient element 16 will push the push rod 15 longitudinally downward. The third holding portion 13 will then clamp against the nut 40 again, causing the spanner's U-shaped region 23 to engage the nut 40 immediately, so as to permit the spanner's rotation to the second position. This results in quick manipulation of the spanner.

Figure 7:
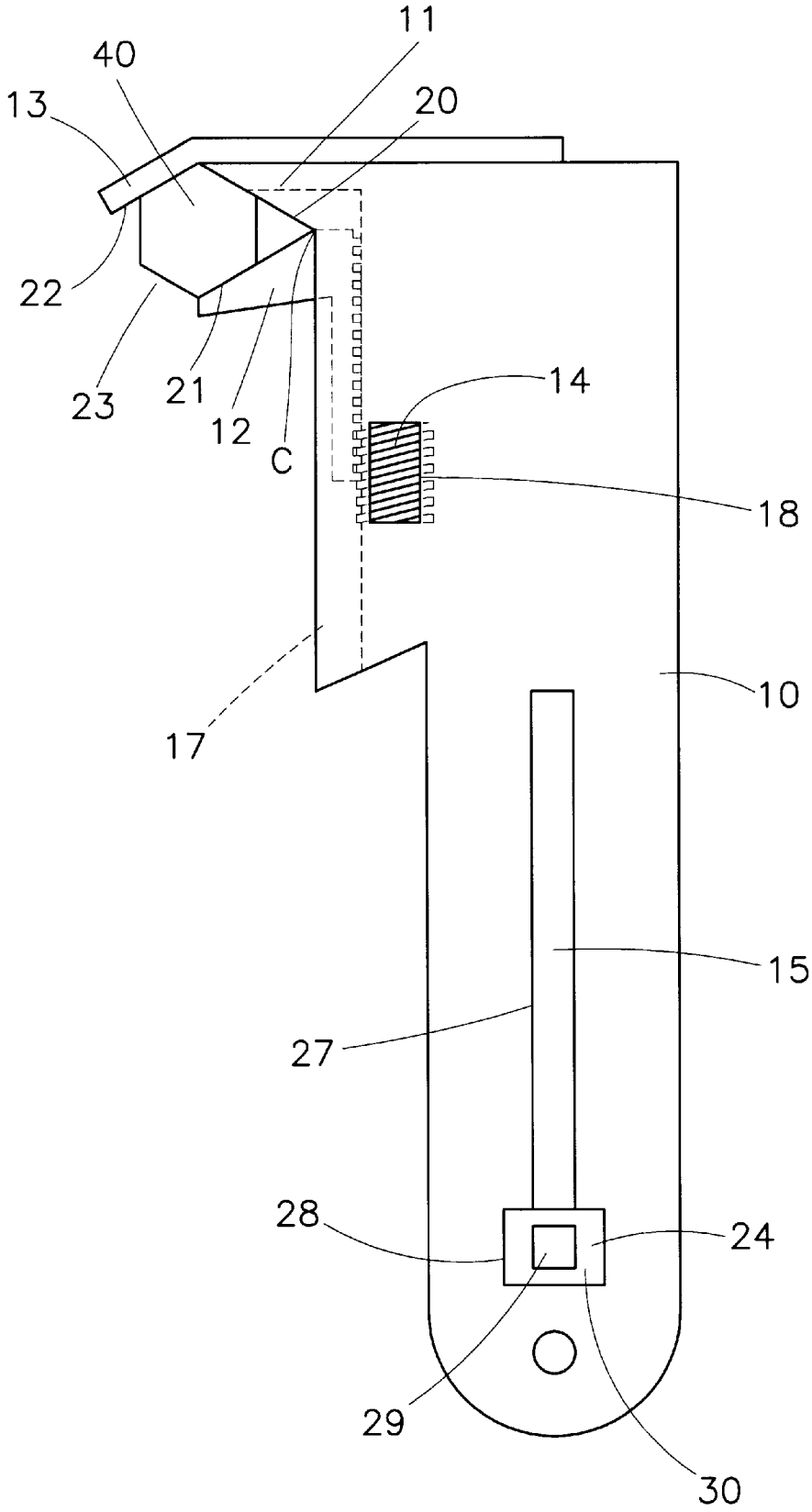
FIG. 7 is a schematic view of the first embodiment of the present invention shown performing another clamping action; and, FIG. 8 is schematic view of another embodiment of the present invention.
Figure 8:
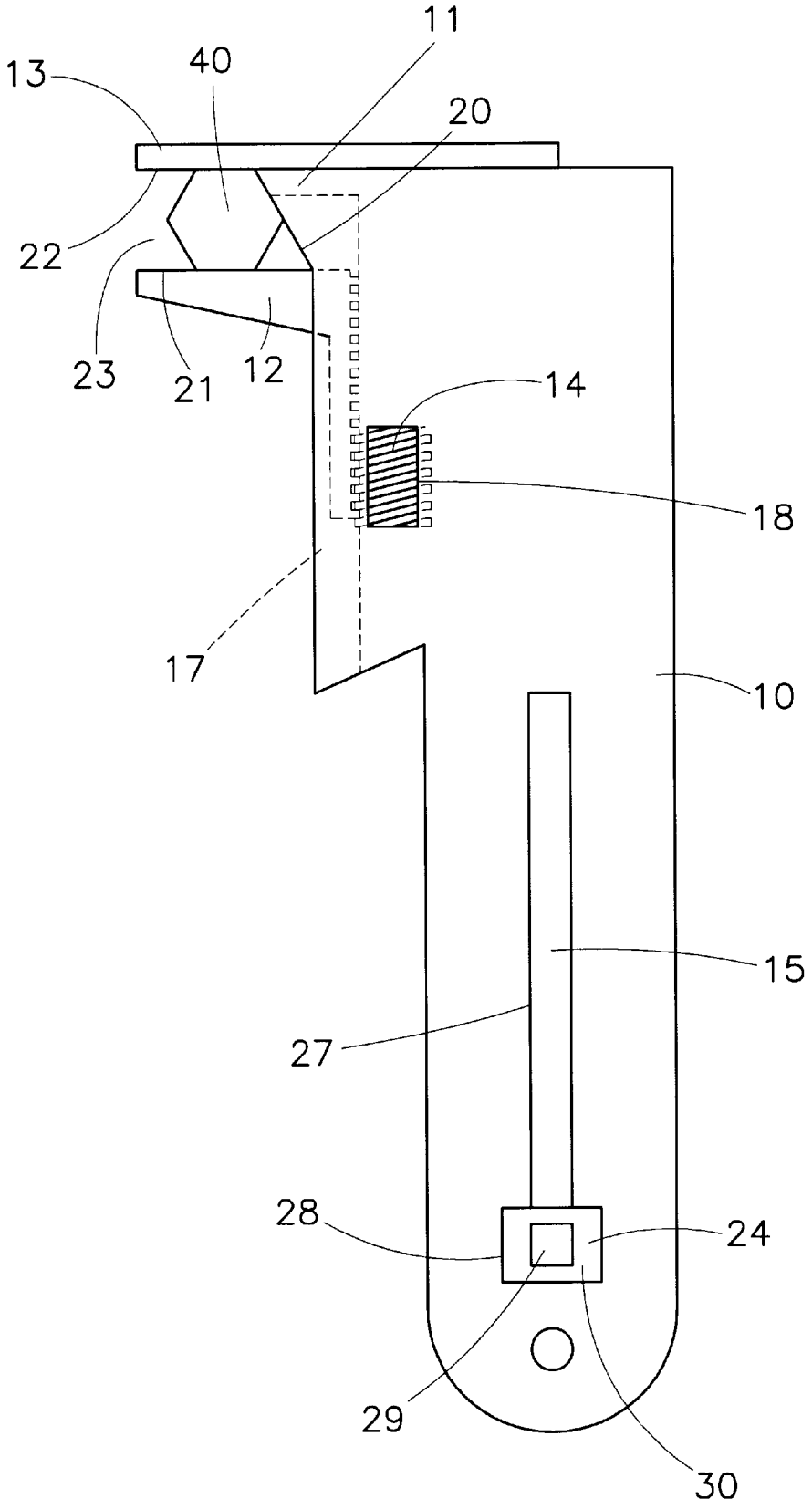

As shown in FIG. 7, the second holding portion 12 may be configured with a shovel structure. When the second holding portion 12 is tightly locked, it will not stop at point C. If a smaller nut is used, it may advance further to clamp even more tightly. As shown in an alternate embodiment of the present invention of FIG. 8, the orientations of the first contact surface 20, second contact surface 21, and third contact surface 22 may be varied to attain similar effect.

In summary, the defect in the prior art, wherein only two surfaces for engaging contact of a nut are restrictively provided, is overcome by the present invention.

Although the present invention has been described with reference to the preferred embodiments, it will be understood that the invention is not limited to the details described therefor. Various substitutions and modifications have been suggested in the foregoing Description, however, others will occur to those of ordinary skill in the art. Therefore, all such substitutions and modifications are intended to be embraced within the scope of the invention as defined in the appended Claims.

What is claimed is:

1. An adjustable spanner comprising:

(a) a handle having first and second end portions and an intermediate portion extending longitudinally therebetween, said handle having formed therein first and second assembling holes;

(b) a first holding portion fixedly coupled to said first end portion of said handle, said first holding portion defining a first contact surface;

(c) a second holding portion adjustably coupled to said first end portion of said handle, said second holding portion defining a second contact surface selectively displaced from said first contact surface;

(d) a third holding portion coupled to said first end portion of said handle in displaceable manner between a clamping position and a releasing position, said third holding portion defining a third contact surface, said third contact surface being disposed in said clamping position adjacent at least one of said first and second contact surfaces to collectively defining with said first and second contact surfaces a substantially U-shaped engagement region, said third contact surface being disposed in said releasing position substantially offset from said first and second contact surfaces;

(e) a push rod coupled to said third holding portion for actuating said displacement thereof between said clamping and releasing positions, said push rod having a first section disposed in displaceable manner within said second assembling hole of said handle and a second section extending longitudinally therefrom, said push rod including an actuation button protruding from said second section; and, (f) a first resilient element coupled to said first section of said push rod, said first resilient element biasing said push rod relative to said handle to thereby bias said third holding portion to said clamping position.

2. The adjustable spanner as recited in claim 1 further comprising an adjustment member coupled to said second holding portion for actuating said adjustment thereof, said adjustment member being disposed in said first assembling hole of said handle.

3. The adjustable spanner as recited in claim 2 wherein said second holding portion slidably engages a guide groove formed in said first end portion of said handle.

4. The adjustable spanner as recited in claim 1 wherein said end portion of said handle has formed therein a positioning groove and said intermediate portion of said handle has formed therein a slot having a substantially T-shaped sectional contour extending longitudinally from said positioning groove, said T-shaped slot defining a narrow slot portion communicating with a wide slot portion.

5. The adjustable spanner as recited in claim 4 wherein said actuation button includes a narrow button portion adapted for slidable engagement with said narrow slot portion, said actuation button engaging said positioning groove in depressible manner for locking said push rod against longitudinal displacement relative to said handle when said third holding portion is disposed in said clamping position, said actuation button being adapted for disengagement from said positioning groove responsive to depression thereof sufficient to substantially align said narrow button and narrow slot portions.

6. The adjustable spanner as recited in claim 5 further comprising a second resilient element coupled to said actuation button for biasing said actuation button outward from said handle.

7. The adjustable spanner as recited in claim 1 wherein said second contact surface is formed with a substantially shovel-like contour.

8. The adjustable spanner as recited in claim 1 wherein said first and second contact surfaces are disposed in non-parallel manner one relative to the other.

9. The adjustable spanner as recited in claim 1 wherein said first and second contact surfaces oppose one another in substantially parallel manner.

* * * * *